US006106304A

United States Patent [19]

Huang

[11] Patent Number: 6,106,304

[45] Date of Patent: Aug. 22, 2000

[54] CABLE CONNECTING HEAD FOR CONNECTING TO AN INTEGRAL CIRCUIT BOARD

[76] Inventor: Chung Chuan Huang, No. 92, Alley 105, Lane 274, Chuon-Chen South Road, Yuong Kan City, Tainan Hsieh, Taiwan

[21] Appl. No.: 09/266,722

[22] Filed: Mar. 12, 1999

[51] Int. Cl.[7] ..... H01R 9/09

[52] U.S. Cl. ..... 439/63; 439/581

[58] Field of Search ..... 439/63, 581, 74, 439/79

[56] References Cited

U.S. PATENT DOCUMENTS

| | | | |
|---|---|---|---|
| 3,980,382 | 9/1976 | Reeder | 439/63 |
| 5,011,415 | 4/1991 | Suzuki et al. | 439/63 |
| 5,662,481 | 9/1997 | Wright | 439/63 |
| 5,730,621 | 3/1998 | Wang | 439/63 |
| 5,735,695 | 4/1998 | Heinrich | 439/63 |
| 5,897,384 | 4/1999 | Hosler, Sr. | 439/63 |
| 5,904,578 | 5/1999 | Kubota et al. | 439/63 |

*Primary Examiner*—Brian Sircus
*Assistant Examiner*—J. F. Duverne
*Attorney, Agent, or Firm*—Rosenberg, Klein & Lee

[57] ABSTRACT

A cable connecting head includes a tubular part (1) and a semi-circular protrusion part (2) which extends longitudinally from a distal end of the tubular part (1). Insertions (11) extend from the side portions of the semi-circular protrusion part (2), and a metal cord (13) extends centrally relative to the tubular part (1). The insertions (11) are adapted to engage corresponding apertures (32) in an integral circuit board (3). Two notches (12) are defined at the distal end of the tubular part (1) so as to receive an edge of the integral circuit board (3).

4 Claims, 6 Drawing Sheets

CABLE CONNECTING HEAD FOR CONNECTING TO AN INTEGRAL CIRCUIT BOARD

FIELD OF THE INVENTION

The present invention relates to a cable connecting head of an electric product, and more particularly, to a connecting head having two insertions to engage with the integral circuit board and a notch defined in the base portion of the connecting head for hold the side of the integral circuit board.

BACKGROUND OF THE INVENTION

A conventional way to connect the integral circuit board to the signal cables is to soldering the metal cable in the cable to the pre-determined points on the integral circuit board. Nevertheless, the manufacturers usually use a very small amount soldering material to solder the metal cable to the integral circuit board so as to reduce the manufacturing cost. Therefore, the connection between the integral circuit board, the tip of the metal cable and the integral circuit board is easily separated with each other if the product is incurred an impact or improperly placed. Once the connection is broken, the users have to spend time to fix it or send the produce to the repairers. On the other hands, because the conventional way to connect the metal cord to the integral circuit board is to directly solder the tip of the cable on the integral circuit board, the inherent shortcoming mentioned above are difficult to avoid.

The present invention intends to provide a cable connecting head which has two insertions to securely engage with two apertures of the integral circuit board and a notch for holding the side of the integral circuit board. By the connecting head of the present invention, the connection between the integral circuit board and the cable connecting head is firmly secured. Therefore, the shortcomings of the conventional connection of the integral circuit board and the cable connecting head are mitigated and/or obviated.

SUMMARY OF THE INVENTION

In accordance with one aspect of the present invention, there is provided a cable connecting head comprising a tubular part with a metal cord extending centrally from the distal end thereof and a semi-circular protrusion extending longitudinally from the distal end of the tubular part. Two insertions respectively extend from two sides of the semi-circular protrusion.

The main object of the present invention is to provide a cable connecting head which has two insertions securely engaged with two apertures defined through the integral circuit board.

Another object of the present invention is to provide a cable connecting head which has two notches defined in the distal end thereof so as to hold a side of the integral circuit board.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
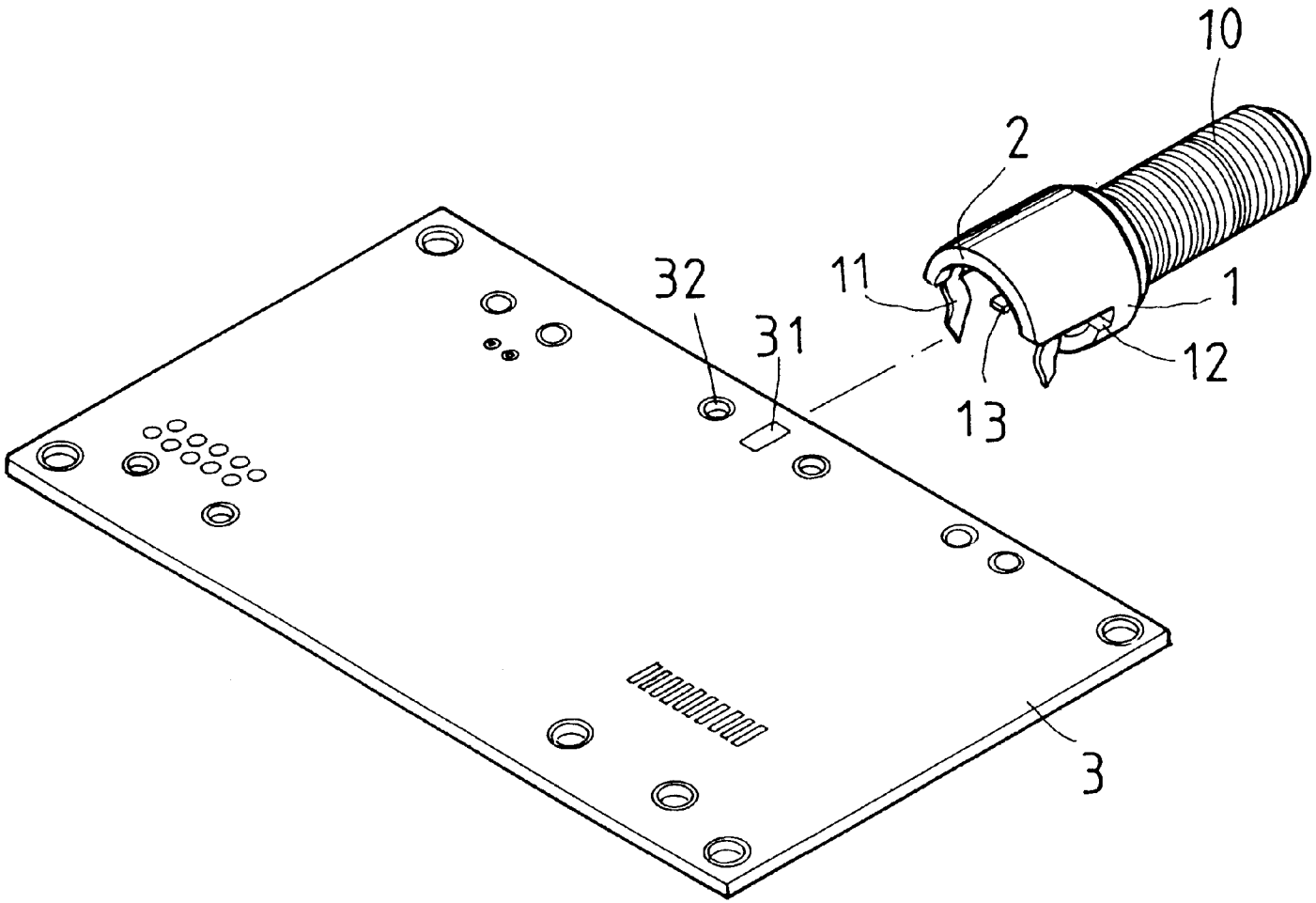
FIG. 1 is an exploded view of the cable connecting head in accordance with the present invention and an integral circuit board.
Figure 2:
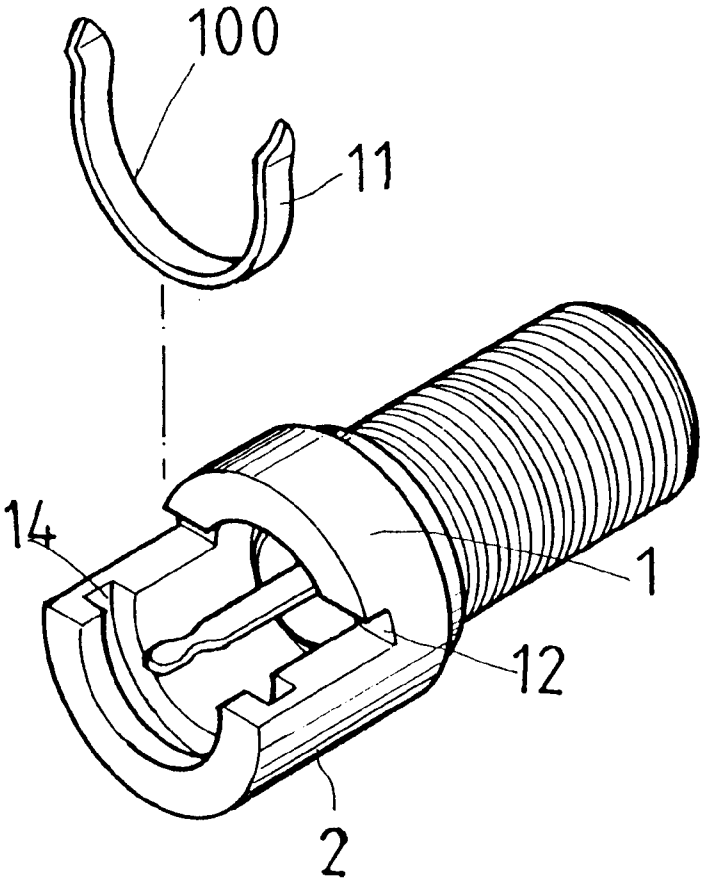
FIG. 2 is an exploded view of the cable connecting head in accordance with the present invention.
Figure 3:
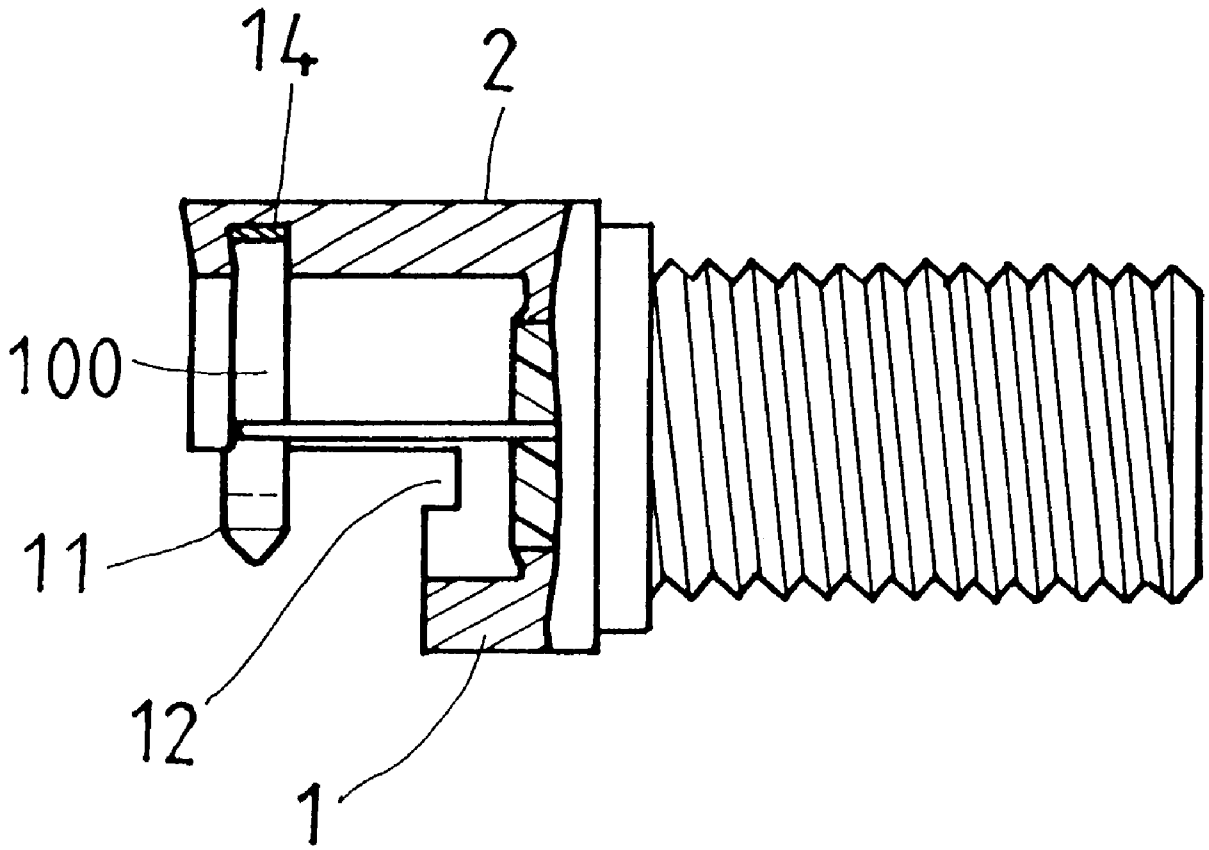
FIG. 3 is a side elevational view, partly in section, of the cable connecting head in accordance with the present invention.

Referring to FIGS. 1 to 3, the cable connecting head in accordance with the present invention comprises a tubular part (1) which extends longitudinally from a cable connector part (10) and a semi-circular protrusion port (2) extends longitudinally from the distal end of the tubular part (1). A metal cord (13) extends centrally from the tubular part (1). The semi-circular protrusion (2) has a groove (14) radially defined in the inside thereof so that a U-shaped member (100) is securely engaged with the groove (14). The two ends of the U-shaped member (100) extend from the two sides of the semi-circular protrusion (2), the two ends of the U-shaped member (100) perform as two insertions (11) which extend from two sides of the semi-circular protrusion (2). Two notches (12) are defined in the distal end of the tubular part (1) and located on the root portion of the semi-circular member (2).

Figure 4:
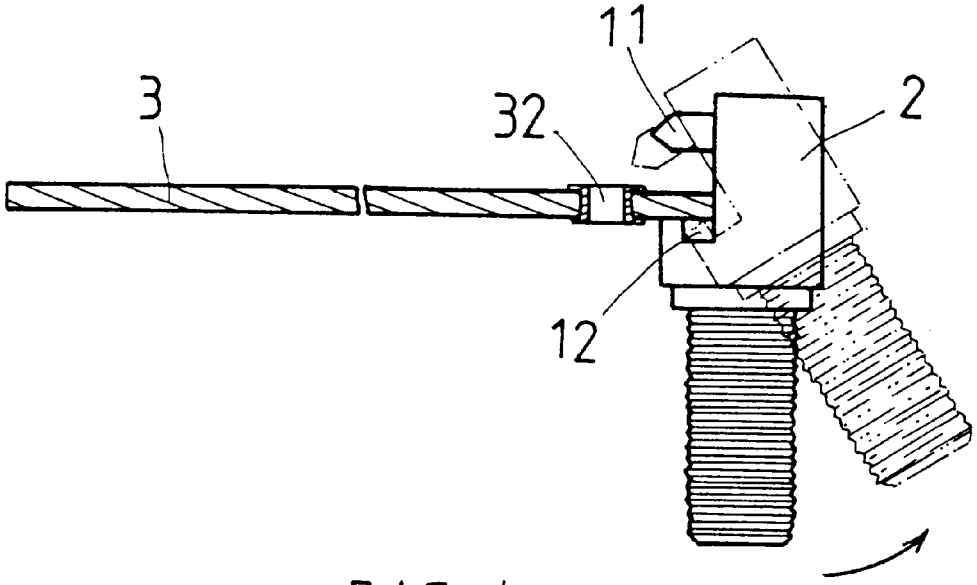
FIG. 4 is a side elevational view to show the first step that the cable connecting head is to be engaged with the integral circuit board.
Figure 5:
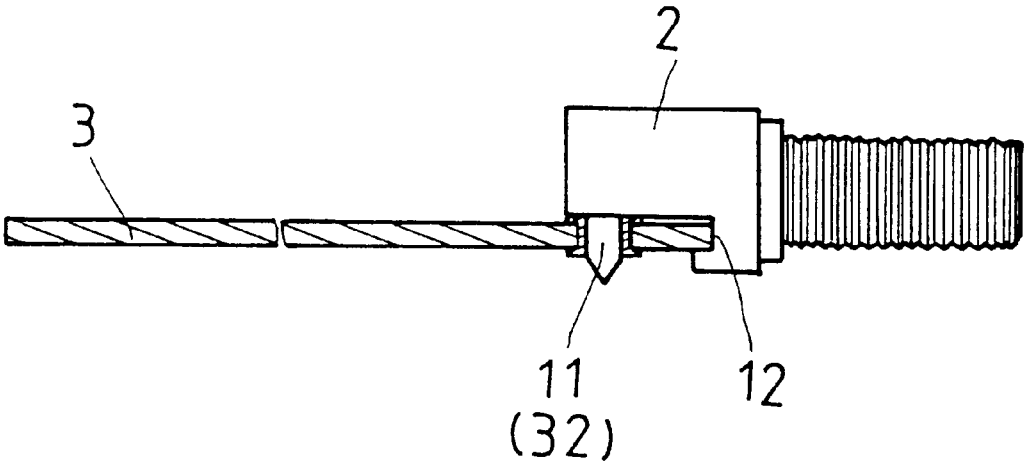
FIG. 5 is a side elevational view to show the second step that the two insertions of the cable connecting head are engaged with two apertures of the integral circuit board.
Figure 6:
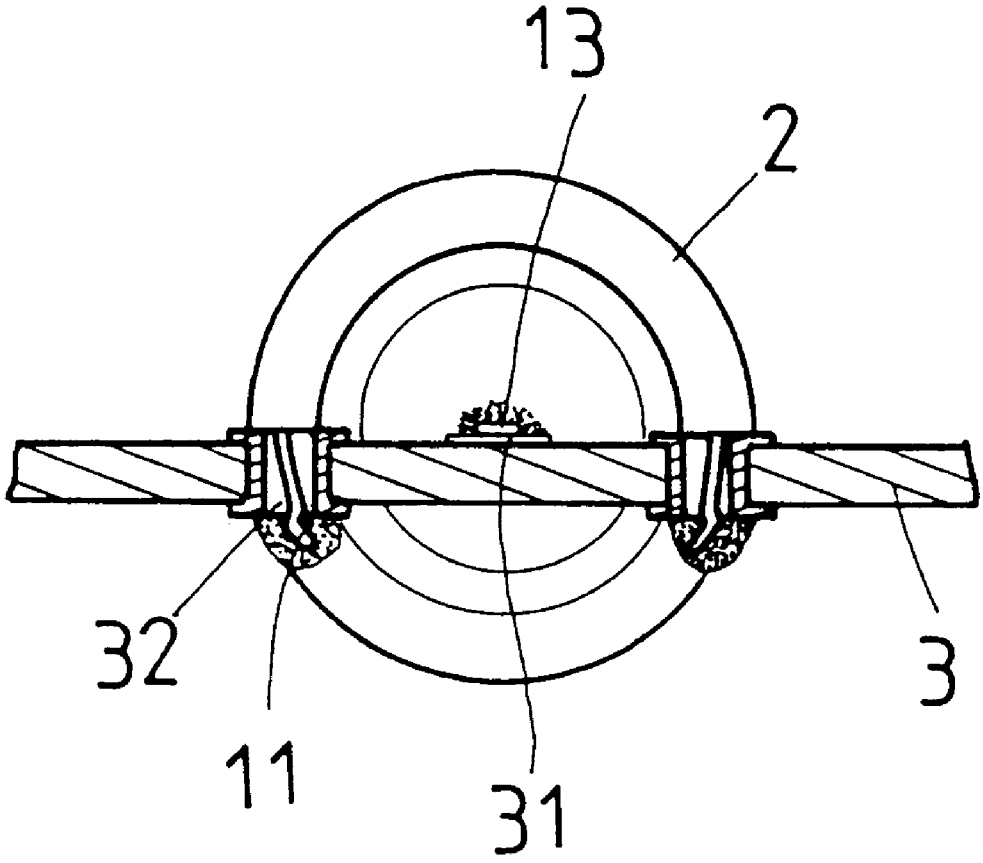
FIG. 6 is an end view to show the two insertions and the metal cord are soldered to the integral circuit board.
Figure 7:
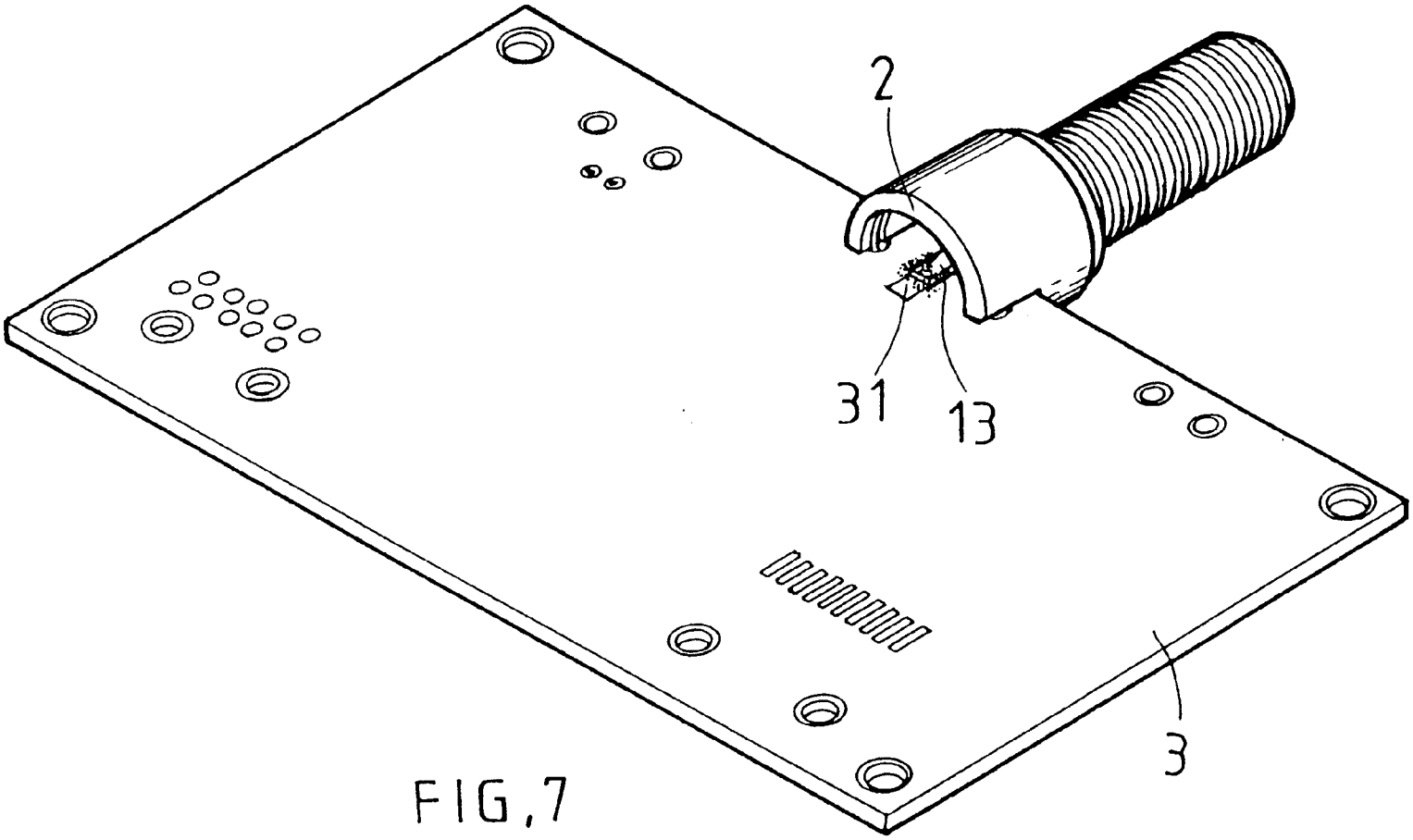
FIG. 7 is a perspective view to show the cable connecting head is connected to the integral circuit board.

Referring to FIGS. 4 and 5, when connecting the cable connecting head to the integral circuit board (3), a side of the integral circuit board (3) firstly contacts against the two sides of the semi-circular protrusion (2) and then rotating the cable connecting head to let the two insertions (11) inserted into two apertures (32) (see FIGS. 1, 5 and 7). The side of the integral circuit board (3) is then received in the two notches (12) in the tubular part (1) and the metal cable (13) contacts the contact point (31). Soldering process is then applied to the engagement of the two insertions (11) and the two apertures (32), and the metal cord (13) and the contact point (31) as shown in FIG. 6.

By the cable connecting head of the present invention, the connecting head will be securely connected to the integral circuit board (3) and the engagement between the connecting head and the integral circuit board (3) will not be separated even if an impact is directly applied to the integral circuit board (3) or the cable connecting head.

While we have shown and described various embodiments in accordance with the present invention, it should be clear to those skilled in the art that further embodiments may be made without departing from the scope and spirit of the present invention.

What is claimed is:

1. A cable connecting head comprising:

(a) a cable connector part;

(b) a substantially tubular part coupled to said cable connector part, said tubular part having formed therein at least a pair of axially extended notches offset one from the other for engaging an edge of a circuit board;

(c) a protrusion part projecting axially from said tubular part, said protrusion part including a substantially semi-circular sectional contour defined by an arcuate wall portion terminating at a pair of side portions, said side portions each being disposed adjacent one said notch of said tubular part;

(d) an insertion protruding from each said side portion of said protrusion part; and, (e) a metal cord coupled to said cable connector part to project in substantially coaxial manner relative to said tubular and protrusion parts.

2. The cable connecting head as recited in claim 1 wherein said wall portion of said protrusion part has formed therein a groove, said groove extending from one said side portion to the other.

3. The cable connecting head as recited in claim 2 further comprising a substantially U-shaped member received in said groove of said protrusion part, said U-shaped member defining said insertions.

4. The cable connecting head as recited in claim 1 wherein said cable connector, tubular, and protrusion parts are coaxially disposed.

* * * * *